United States Patent [19]

Denzinger et al.

[11] 4,444,561

[45] Apr. 24, 1984

[54] COPOLYMERS WHICH CONTAIN BASIC GROUPS AND ARE USED AS ANTIREDEPOSITION AGENTS IN WASHING AND AFTER-TREATING TEXTILE GOODS CONTAINING SYNTHETIC FIBERS

[75] Inventors: Walter Denzinger, Speyer; Wolfgang Trieselt, Ludwigshafen; Johannes Perner, Neustadt; Heinrich Hartmann, Limburgerhof, all of Fed. Rep. of Germany

[73] Assignee: BASF Aktiengesellschaft, Ludwigshafen, Fed. Rep. of Germany

[21] Appl. No.: 467,443

[22] Filed: Feb. 17, 1983

[30] Foreign Application Priority Data

Feb. 26, 1982 [DE] Fed. Rep. of Germany ..... 3206883

[51] Int. Cl.[3] ..... B08B 3/04

[52] U.S. Cl. ..... 8/137; 252/174.23

[58] Field of Search ..... 8/137

[56] References Cited

U.S. PATENT DOCUMENTS 3,749,682 7/1973 Tanner .

4,088,610 5/1978 Bevan et al. ..... 252/541

FOREIGN PATENT DOCUMENTS 1534641 12/1978 United Kingdom .

*Primary Examiner*—Maria Parrish Tungol

*Attorney, Agent, or Firm*—Oblon, Fisher, Spivak, McClelland & Maier

[57] ABSTRACT

Textile goods containing synthetic fibers are washed and after-treated by a process wherein, as an antiredeposition agent, a copolymer is employed which contains, as copolymerized monomers, (a) from 50 to 90% by weight of one or more vinyl esters of $C_1$–$C_4$ aliphatic carboxylic acids, (b) from 5 to 35% by weight of one or more N-vinyllactams, (c) from 1 to 20% by weight of one or more monomers containing basic groups, or of salts or quaternization products of these monomers, and (d) from 0 to 20% by weight of one or more further monomers which are copolymerizable with monomers (a), (b) and (c) and are free from carboxyl and basic groups, the percentages in each case being based on the sum of the monomers, with the proviso that the percentages sum to 100.

2 Claims, No Drawings

COPOLYMERS WHICH CONTAIN BASIC GROUPS AND ARE USED AS ANTIREDEPOSITION AGENTS IN WASHING AND AFTER-TREATING TEXTILE GOODS CONTAINING SYNTHETIC FIBERS

The present invention relates to the use of certain copolymers modified by basic groups, as redeposition inhibitors in washing and after-treating textile goods containing synthetic fibers.

Legislation in many countries stipulates, as a minimum requirement, that the content of phosphates in detergents must be greatly reduced. However, this leads to problems insofar as phosphates act not only as sequestering agents for alkaline earth metal ions but also as incrustation inhibitors and antiredeposition agents. While the problem of incrustation, ie. of deposits of mineral origin on the goods being washed, has been solved in another way, the problem of redeposition, ie. resoiling of the wash with the dirt particles and fats, particularly in the case of fabrics containing synthetic fibers, has not been completely solved to date. In the case of natural fibers, eg. cotton, carboxymethylcellulose has been employed hitherto for this purpose, but this substance cannot be used successfully in the case of, for example, polyester-containing textiles.

British Pat. No. 1,534,641 discloses certain cellulose ethers which are capable of providing fairly good inhibition of redeposition.

German Laid-Open Application DOS Nos. 2,165,898 and 2,139,923 disclose antiredeposition agents based on copolymers of vinylpyrrolidone with vinyl acetate. However, none of these proposals are completely satisfactory since the suggested agents are either too expensive (cellulose ethers) or, especially in the case of polyester-containing textile goods, not sufficiently effective.

It is an object of the present invention to provide products which are more effective than the prior art compounds and by means of which satisfactory inhibition of redeposition can also be achieved in the washing and after-treatment of textile goods containing synthetic fibers, especially of polyester fabrics.

We have found, surprisingly, that this object is achieved by the addition of copolymers as defined in the claims. We have found that, for example, certain vinylpyrrolidone/vinyl acetate copolymers mentioned in the above German Laid-Open Application DOS Nos. 2,165,898 and 2,139,923, provided that the comonomers containing basic groups are present in these copolymers only in an amount according to the definition, exhibit an unexpectedly great improvement in their soil-suspending power, ie. their inhibition of redeposition.

Such modified copolymers, in the form of their salts, have been used hitherto, for example as film formers in hair sprays, but no applications in the detergent sector have been disclosed hitherto.

Comonomers (a) for the preparation of the copolymers used according to the invention are vinyl esters of $C_1$–$C_4$ aliphatic carboxylic acids. These include vinyl formate, vinyl acetate, vinyl propionate and vinyl butyrate, vinyl acetate or vinyl propionate being preferably employed. The copolymers contain from 50 to 90, preferably from 70 to 85, % by weight of the comonomers (a).

Comonomers (b) are N-vinyllactams, including, for example, N-vinylpyrrolidone, N-vinylcaprolactam and N-vinylcarbazole. N-vinylpyrrolidone is preferred. The copolymerization is carried out using from 5 to 30, preferably from 5 to 20, % by weight of comonomers (b).

Comonomers (c) are the monomers containing basic groups. For the purposes of the invention, these are monomers which contain a basic nitrogen atom capable of forming a salt or a quaternized product. For example, these monomers include vinylpyridine, vinylpiperidine, vinylimidazole, vinylmethylimidazole, dimethylaminomethyl acrylate and methacrylate, dimethylaminoethyl acrylate and methacrylate, diethylaminomethyl acrylate and methacrylate, dimethylaminoneopentyl acrylate and methacrylate, dimethylaminopropyl acrylate and methacrylate and diethylaminoethyl acrylate or methacrylate, as well as their water-soluble homologs. The copolymerization is carried out using from 1 to 20, preferably from 2 to 12, % by weight of comonomers (c).

Comonomers (d), which can be present as copolymerized units in an amount of not more than 20% by weight, are those which are copolymerizable with comonomers (a), (b) and (c), and contain neither basic nor carboxyl groups. Such comonomers should advantageously contain no more than 7 carbon atoms, in order to ensure that the resulting copolymer is water-soluble. Examples of such comonomers include acrylates and methacrylates, eg. methyl, ethyl, propyl and butyl acrylates and the corresponding methacrylates, and vinyl ethers, eg. vinyl methyl ether, vinyl ethyl ether and vinyl isobutyl ether.

The polymerization is carried out as a conventional free-radical precipitation, solution, emulsion or suspension polymerization. Solution polymerization is preferred, examples of suitable solvents being monohydric and polyhydric alcohols, eg. methanol, ethanol, isopropanol, glycol, butylglycol and neopentylglycol, and ketones, eg. acetone and methyl ethyl ketone. The stated polyhydric alcohols are preferably employed as solvents since these alcohols do not need to be separated off from the prepared copolymers but can be incorporated, as washing assistants, into the detergents.

Suitable free radical initiators are the conventional per and azo compounds, including, for example, t-butyl perethylhexanoate and especially azoisobutyronitrile.

The polymerization is conventionally carried out at from 60° to 130° C. After the polymerization, the polymers may be converted into their salts, eg. acetates, or quaternized with an alkyl halide, eg. methyl chloride, or dimethyl sulfate or methyl p-toluenesulfonate. The copolymers obtained can be used in conventional detergents having a reduced phosphate content (previously from 40 to 50% by weight), or in those containing no phosphates.

Such detergents contain, for example, from 10 to 30% by weight of sodium tripolyphosphate, from 10 to 20% by weight, depending on the reduction in phosphate content, of a phosphate substituent, eg. zeolite, from 5 to 20% by weight of a non-ionic surfactant, eg. a $C_8$–$C_{12}$-alkylphenol oxyethylate or a $C_{12}$–$C_{20}$-alkanol oxyethylate, block copolymers of ethylene oxide and propylene oxide, all of which may possess blocked terminal groups, from 5 to 20% by weight of an anionic surfactant, eg. a $C_8$–$C_{12}$-alkylbenzenesulfonate, a $C_{12}/C_{16}$-alkanesulfonate, a $C_{12}/C_{16}$-alkylsulfate, a $C_{12}$–$C_{16}$-alkylsulfosuccinate or a sulfated, oxyethylated $C_{12}/C_{16}$-alkanol, and if appropriate also from 1 to 3% by weight of an incrustation inhibitor, eg. polymaleic acid, maleic acid/acrylic acid copolymers, polyacrylic acid or the salts thereof, from 3 to 25% by weight of a bleaching agent, eg. Na perborate together with a bleach activator, and from 10 to 30% by weight of a standardizing agent, eg. $Na_2SO_4$, as well as soaps, alkalis, eg. sodium carbonate, softeners and perfumes.

The amount of copolymer employed according to the invention depends on the type of surfactants used, and is greater if anionic surfactants predominate but smaller if more non-ionic surfactants are present, since the latter exhibit a redeposition-inhibiting effect, even though this effect is small.

The novel compounds ought to be regarded predominantly as being non-ionic or weakly cationic, so that they are well tolerated by anionic constituents of the detergent, and may be readily incorporated into the formulations.

The copolymers are added in general in an amount of from 0.2 to 3, preferably from 0.5 to 2%, by weight, based on solid detergent constituents.

Another possible method of using the copolymers for the same purpose of preventing redeposition on washed white goods composed of synthetic fibers is as follows: If, for example, the compounds used according to the invention are added to the last rinse in a washing machine cycle, where these compounds may be added either together with a softener conventionally used at this point (Example 18) or, if it is not desired to use a softener, alone instead of the softener (Example 15), the novel antiredeposition agent, absorbed either together with the softener or alone, has the effect that, in the next wash cycle, the washing becomes much less soiled than in the absence of the antiredeposition agent. Although the prior art substituted cellulose ethers, when employed alone, produce similar effects, these compounds either are ineffective or even produce soiling when employed together with a softener, since they are not compatible with the cationic softener, as shown in Examples 16 and 19 below.

The Examples which follow illustrate the invention.

(A) Test methods (1) Demonstration of the redeposition-inhibiting effect:

A polyester test fabric, or in some cases a polyester/cotton union fabric, was subjected to a series of 5 washes, together with a standard soiled cloth. The soiled cloth was replaced after each wash, while the test fabric became increasingly soiled after each wash. The degree of whiteness of the test fabric after the fifth wash was used to assess the degree of soiling, the values being established by repeating the experiment several times and calculating average values.

| Test conditions | |
|---|---|
| Hardness of the water | 16° d |
| Amount of liquor | 250 ml |
| Liquor ratio | 1:12.5 |
| Experimental temperature | 35–60° C. |
| Duration of experiment | 30 minutes (including heating time) |
| Detergent concentration | 5 g/liter |

In the Example, the antiredeposition agent added in an amount of 1% by weight, based on the test detergent. The test vessels contained, in each case, 15 g of test fabric and 5 g of soiled cloth. The soiled cloth used was, on the one hand, a WKF soiled cotton cloth from the Wäschereiforschungsanstalt (Laundry Research Institute) Krefeld, which contained as dirt both wool fat and pigment dirt, and on the other hand a soiled cloth containing only the fat-free pigment dirt of the same composition.

The degertent used was of the following composition:

| | |
|---|---|
| $C_{12}$—alkylbenzenesulfonate | 10% |
| Tallow fatty alcohol × 11 ethylene oxide | 5% |
| Soap | 3% |
| Na tripolyphosphate | 30% |
| Na perborate (tetrahydrate) | 20% |
| $Na_2SO_4$ | 20% |
| Remainder | water to 100% |

The above detergent is thus one having a moderately reduced phosphate content, as available commercially since October 1981, after the regulation in respect of maximum amount of phosphate was added to the German Law on Detergents.

(2) Demonstration of the redeposition-inhibiting effect when used in the final rinse The test is carried out as described under (1), except that between the wash cycles, in addition to the two intermediate rinsing operations carried out in Method 1, a treatment for 5 minutes with 0.05 g/liter of the antiredeposition agent or with a mixture of 0.2 g/liter of softener and 0.1 g/liter of antiredeposition agent is carried out. In this test method, the inhibitor is of course not added to the detergent.

(B) The results are given in the tables below.

TABLE 1

Redeposition according to Method 1, degree of whiteness of the test cloth after 5 washes, measured with Elrepho (Filter 8)

| Example No. | Antiredeposition agent Polymer of | Soiled cloth WFK Test fabric PES | WFK PES/C | Pigment PES | Pigment PES/C |
|---|---|---|---|---|---|
| 1 | — | 54.0 | 55.0 | 69.8 | 51.5 |
| 2 | VP | 56.0 | 57.4 | 73.1 | 65.2 |
| 3 | 50:50 VP/VAc | 56.1 | 56.2 | 73.6 | 65.0 |
| 4 | 20:80 VP/VAc | 57.5 | 57.0 | 73.2 | 64.8 |
| 5 | 10:90 VP/VAc | 58.1 | 58.9 | 73.2 | 65.1 |
| 6 | 12:84:4 VP/VAc/VMI | 64.5 | 60.2 | 74.6 | 65.6 |
| 7 | 12:84:4 VP/VAc/VPy | 64.2 | 59.6 | 75.0 | 66.3 |
| 8 | 10:86:4 VP/VPr/DEAEA | 63.2 | 60.1 | 74.8 | 66.8 |
| 9 | Acetate of 13:83:4 VC/VAc/DEAEA | 61.6 | 60.0 | 73.7 | 64.9 |
| 10 | 16:80:4 VP/VAc/DMAMA | 60.4 | 60.1 | 74.4 | 65.7 |
| 11 | 13:73:10:4 VP/VAc/EA/DEAEA | 61.1 | 60.4 | 74.1 | 64.9 |
| 12 | 10:84:6 VP/VPr/DEAEA | 63.0 | 61.1 | 74.3 | 66.6 |
| 13 | Hydroxypropylmethylcellulose | 77.1 | 67.5 | 69.6 | 59.1 |

Abbreviations:
VP: vinylpyrrolidone
VAc: vinyl acetate
VMI: vinylmethylimidazole
Vpy: vinylpyridine
VC: N—vinyl caprolactam
DEAEA: diethylaminoethyl acrylate
DMAMA: dimethylaminomethyl acrylate
Vpr: vinyl propionate As can be seen from Table 1, in the case of fat-containing pigment dirt (WFK soiled cloth) Examples 6, 7, 8, 9, 10, 11 and 12 according to the invention are substantially better in preventing redeposition both on polyesters (PES) and on polyester/cotton union fabrics (PES/C) than polyvinylpyrrolidone or its copolymers with vinyl acetate. In the case of this soiling, the values obtained with hydroxypropylmethylcellulose are, however, not reached.

In the case of pigment dirt alone, ie. in the absence of fat, the two groups of examples, ie. 2, 3, 4 and 5, and 6, 7, 8, 9, 10, 11 and 12 according to the invention, show almost identical behavior, with the last-mentioned group of examples having only small advantages, whereas the values for hydroxypropylmethylcellulose decrease considerably. Pigment dirt encountered in practice has a fat content between these two extreme groups of dirt.

TABLE 2

Redeposition according to Method 2, degree of whiteness of the test fabric after 5 washes/after-treatment cycles, measured with Elrepho (Filter 8)

| Example No. | Antiredeposition agent in the after-treatment bath | Soiled cloth: WFK, Test fabric: PES | WFK, PES/C | Pigment, PES | Pigment, PES/C |
|---|---|---|---|---|---|
| 14 | — | 49 | 50 | 73 | 60 |
| 15 | 30:67:3 VP/VAc/DMAMA | 77 | 55 | 78 | 66 |
| 16 | Hydroxypropylmethylcellulose | 79 | 61 | 68 | 59 |
| 17 | DMDSACl | 54 | 52 | 73 | 61 |
| 18 | Example 15 + DMDSACl | 78 | 65 | 77 | 68 |
| 19 | HPMC/DMDSACl | 65 | 50 | 68 | 61 |

Abbreviations:
DMDSACL: dimethyldistearylammonium chloride
HPMC: hydroxypropylmethylcellulose As can be seen from Table 2, in the case of high-fat pigment dirt (WFK soiled cloth) one example from the novel compounds has a redeposition-inhibiting effect which is almost as good as that of HPMC when it is employed in an after-treatment bath corresponding to the last rinsing operation in a washing machine; in the case of pigment dirt alone, the novel compound is even superior. The superiority of the compounds according to the invention becomes quite obvious when the antiredeposition agents are employed together with a cationic softener in the last rinse, regardless of the type of dirt.

We claim:

1. A process for washing and after-treating textile goods containing synthetic fibers, wherein, as an antiredeposition agent, a copolymer is employed which contains, as copolymerized monomers,
   (a) from 50 to 90% by weight of one or more vinyl esters of $C_1$–$C_4$ aliphatic carboxylic acids,
   (b) from 5 to 35% by weight of one or more N-vinyllactams,
   (c) from 1 to 20% by weight of one or more monomers containing basic groups, or of salts or quaternization products of these monomers, and
   (d) from 0 to 20% by weight of one or more further monomers which are copolymerizable with monomers (a), (b) and (c) and are free from carboxyl and basic groups, the percentages in each case being based on the sum of the monomers, with the proviso that the percentages sum to 100.

2. A process as claimed in claim 1, wherein the antiredeposition agent employed is a copolymer of
   (a) vinyl acetate or vinyl propionate,
   (b) N-vinylpyrrolidone or N-vinylcaprolactam, and
   (c) dimethylaminoethyl acrylate or methacrylate, diethylaminoethyl acrylate or methacrylate, dimethylaminomethyl acrylate or methacrylate, diethylaminomethyl acrylate or methacrylate, dimethylaminoneopentyl acrylate or methacrylate and/or dimethylaminopropyl acrylate or methacrylate.

* * * * *